US006112692A

United States Patent [19]

Lekhtman

[11] Patent Number: 6,112,692

[45] Date of Patent: Sep. 5, 2000

[54] DUAL HULL KAYAK

[75] Inventor: David Lekhtman, Beaconsfield, Canada

[73] Assignee: Step Jet Corporation, Canada

[21] Appl. No.: 09/108,908

[22] Filed: Jul. 1, 1998

[51] Int. Cl.[7] ..... B63B 35/00

[52] U.S. Cl. ..... 114/347; 114/61.1; 114/61.24

[58] Field of Search ..... 114/343, 347, 114/197, 61.1, 61.24, 361, 362, 364, 283, 288, 292

[56] References Cited

U.S. PATENT DOCUMENTS

| | | | |
|---|---|---|---|
| D. 341,351 | 11/1993 | Arcouette . | |
| 2,666,406 | 1/1954 | Babcock . | |
| 2,918,031 | 12/1959 | Gunderson . | |
| 3,150,386 | 9/1964 | Bastien . | |
| 5,042,416 | 8/1991 | Arcouette | 114/347 |
| 5,189,974 | 3/1993 | Masters . | |
| 5,493,982 | 2/1996 | Carpenter et al. . | |
| 5,522,338 | 6/1996 | Eilert et al. | 114/197 |
| 5,649,498 | 7/1997 | Zigurs . | |

*Primary Examiner*—Stephen Avila
*Attorney, Agent, or Firm*—Mark Kusner

[57] ABSTRACT

The invention relates to dual hull kayak, with a one piece elongate moulded body of a continuous outer membrane enclosing an internal cavity. The kayak body has two lateral side walls and a concave bottom wall joined laterally with a bottom edge of each side wall to define two laterally spaced apart parallel pontoons each with a downwardly pointed keel. The top wall of the kayak body is joined laterally with a top edge of each side wall, to complete the hollow body. The top wall together with the bottom wall define a bridge platform spanning a central longitudinal tunnel between the pontoons. The pontoons support a top portion of the tunnel above the waterline. The top wall has a recessed open cockpit with a self-draining floor, side gunnels, and front and back cockpit walls formed into transverse reinforcing ribs. The simple easily moulded structure is very stable against lateral tipping, whereas conventional kayaks and canoes are very unstable laterally. The dual pointed hull also provides directional stability for straight line padding even by novices. Conventional kayaks or canoes are very difficult to master by novices who often paddle in a zig zig pattern and require a significant degree of skill to paddle in a relatively straight line. The sharp dual hulls reduce drag due to reduced wetted surface. The dual hull kayak is so stable laterally that it can be used as a diving platform and can be remounted by a swimmer from the water without tipping or overturning. Conventional kayaks or canoes require expert level skill to accomplish the same re-entry task. If desired the kayak can be inverted and the tunnel shape of the bottom wall provides a rigid water slide for children, water rescue cradle or can be adapted for use as a suntanning lounge. The kayak body includes bow eyelets and is rigid enough to be safely towed with a tow rope behind a motor boat.

14 Claims, 3 Drawing Sheets

DUAL HULL KAYAK

TECHNICAL FIELD

The invention is directed to a sit on top dual hull kayak of one piece hollow molded construction providing superior lateral stability, straight line padding, minimal wetted surface and self draining recessed open cockpit.

BACKGROUND OF THE ART

Human powered watercraft have historically been used for transport and hunting, however, modern uses more likely involve sport and recreation. The traditional design of canoes and kayaks is often repeated in modern forms of fiber glass or molded plastic. The traditional design involves a single hull which has the advantage of being quickly maneuverable. Especially in the case of sport kayaking, it is important that the kayak can be rotated about a vertical axis very rapidly to enable the paddler to maneuver around rocks and other obstacles. Traditional designs of canoes also include a single hull originally for transporting cargo, although in modern use, canoes are generally used for recreational activities. In both cases, the traditional design of kayaks and canoes is relatively unstable and the passengers must maintain balanced to avoid unintentionally tipping themselves into the water.

Another disadvantage of traditional canoe and kayak designs is the need to develop a technique for paddling in order to direct the watercraft in a relatively straight line. Novices and children often have great difficulty in propelling canoes and kayaks in a straight line and tend to zigzag across the surface of the water as they switch paddling from one side of the watercraft to the other.

While kayaks are generally smaller in size than canoes and produce as little wetted surface as possible, traditional canoe designs present a relatively large hull and develop significant water resistance or drag.

A further disadvantage of kayaks and canoes of traditional design is the inability of persons to re-enter the canoe or kayak after entering the water. In the case of the kayak, it takes great strength and practice to move from an overturned position to an upright position after the kayak tips. This is a technique practiced by expert kayakers and in general, novices and inexperienced paddlers have great difficulty in re-righting the kayak.

In the case of canoes, they generally include a buoyant float at both ends of the canoe to prevent it from sinking. Once a canoe has overturned and the passengers are floating in the water, it is very difficult to re-right the canoe and enter the canoe without tipping it over again. There are techniques for doing this especially when two persons are involved and can balance each other's weight, however, this is a very difficult maneuver beyond the ability of novices and children.

Traditional designs of kayaks and canoes remain popular because they are relatively inexpensive and simple to build and maintain. Despite the disadvantages of lateral instability and paddling difficulty, they remain popular mainly due to their simplicity of operation and well known methods of use. In contrast for example, motorized boats require fuel, generate noise and demand a higher level of care and attention to operate. Watercraft propelled by human arm or leg power are popular in that they are useable by a wide variety of people and are environmentally friendly.

Despite the above preferences for human powered watercraft, there are significant disadvantages in that kayaks and canoes of traditional design are extremely difficult to balance and quite often passengers are tipped over into the water unexpectedly. Even persons who know how to swim well are required to wear lifejackets due to the possibility of unexpected tipping and injury as the passenger collides with the boat or rocks, etc. in the water. The single hull design of kayaks and canoes enables the passenger to rotate and maneuver the personal watercraft very easily, however, this also results in a disadvantage where it requires significant skill and practice to propel a kayak or canoe in a relatively straight line. Long kayaks, due to the difficulty in turning them, often include foot pedals with cables to control a rear rudder.

The prior art is replete with various designs of human powered watercraft reflecting the popularity of this form of transport and recreation. Especially in recent times kayaking and white water rafting are becoming more popular as an adventure recreational activity and there is a desire to produce safe and practical new designs. Of particular interest are plastic or fiberglass molded bodies. These have the advantage of superior buoyancy due to an enclosed air filled cavity, ease of repair and the ability to use mass produced molding techniques common to the plastics industry.

Typical hull shapes include a generally semi-circular hull, rectangular hull and catamaran dual hull shapes. While a semi-circular hull has a comparatively moderate draft and drag, it has low stability. A rectangular shaped hull with the same bouyancy has greater stability and less draft, however, the wetted surface is higher resulting in higher drag. A dual hull catamaran concentrates the bouyancy and weight in the lateral hull areas resulting in relatively high stability with low drag due to the smaller wetted surface. The draft of a catamran hull is relatively high due to the pointed dual hulls.

A design of a molded kayak watercraft is shown in U.S. Design Pat. No. 341,351 to Arcouette. The Arcouette design includes a molded plastic body generally of the shape of traditional kayak but with an open cockpit. The Arcouette design includes a rear keel which projects into the water and impedes rapid rotation. The whole shape of the Arcouette is a traditional rounded single hull with a slightly concave mid bottom portion. This single hull, as in the case of traditional canoes, presents a relatively large wetted surface and results in increased drag and water resistance. Although the hull shape is relatively wide, the smooth rounded shape results in a boat which is easily tipped laterally as in the case of traditional kayak and canoe designs.

It is well known that superior lateral stability is obtained by a catamaran design or dual hull. Also, included in this art are watercraft which include outrigger floats to increase lateral stability and prevent unintentional tipping. For example, U.S. Pat. No. 5,649,498 to Zigurs and U.S. Pat. No. 5,189,974 to Masters present two dual hull kayaks or kayak catamarans to increase lateral stability and impede overturning. As in a traditional catamaran, these designs involve two parallel boat hulls tied together with an upper flexible platform or braces. Such designs are fairly large and are meant to be operated by two or more persons. They are large and heavy and may require a lifting apparatus or dismantling prior to transport.

U.S. Pat. No. 3,150,386 to Bastien provides a kayak watercraft with removable outriggers and floats to improve lateral stability. This type of design does nothing however, to enable the user to paddle in a straight line but merely provides some resistance to overturning at the cost of increased drag when the outriggers contact the water surface. This type of kayak is clearly unsuitable for white water, however, may be suitable for recreational use on relatively calm waters. The increased weight due to the outriggers and complicated assembly severely restrict commercial viability.

Examples of dual hull multi-person catamarans are common. Examples are provided in U.S. Pat. No. 2,918,031 to Gunderson which provides a common motor boat with a catamaran style hull. U.S. Pat. No. 2,666,406 to Babcock describes a dual hull catamaran speed boat with a conventional two hull base spanned by a platform bridge to support the passengers. Between the dual hull is a tunnel which in the case of a speed boat, has the advantage of compressing air and lifting the speed boat to plane on the water surface. Of course, all catamarans due to the buoyant mass on the laterally outward areas of the hull, substantially increase lateral stability against tipping. Motor boats and sail boats which include a catamaran hull also have superior straight line directional stability compared to traditional hulls, however, at the cost of decreased maneuverability.

It is an object of the present invention to combine the advantageous of a catamaran hull with a single molded plastic or fiberglass personal watercraft application.

It is a particular object of the invention to enhance the enjoyment of traditional kayak and canoe personal watercraft with improved directional and lateral tipping stability of a catamaran design.

It is a further object of the invention to utilize the conventional methods known and understood widely in respect of hollow molded plastic boats to produce a unique double hull kayak in a cost effective and efficient manner.

It is a further object of the invention to produce a hull with reduced wetted surface and resulting drag.

DISCLOSURE OF THE INVENTION

The invention provides a dual hull kayak, with a one piece elongate moulded body of a continuous outer membrane enclosing an internal air filled cavity. The kayak body has two lateral side walls and a concave bottom wall joined laterally with a bottom edge of each side wall to define two laterally spaced apart parallel pontoons each with a downwardly pointed keel. The pontoons support the central portion of the kayak or the bridge platform above the water surface.

The top wall of the kayak body is joined laterally with a top edge of each side wall, to complete the hollow body. The top wall together with the bottom wall define a bridge platform spanning a central longitudinal tunnel between the pontoons.

The top wall has a recessed open cockpit with a self-draining floor, side gunnels, and front and back cockpit walls formed into transverse reinforcing ribs. The sharp dual hulls reduce drag due to a reduced wetted surface. The hollow body is very light and the passenger is supported in a recessed self draining open cockpit on a raised bridge platform above the water surface.

The simple easily moulded structure is very stable against lateral tipping, whereas conventional kayaks and canoes are very unstable laterally. The dual pointed hull also provides excellent directional stability for straight line padding even by novices. Conventional kayaks or canoes are very difficult to master by novices who often paddle in a zig zig pattern and require a significant degree of skill to paddle in a relatively straight line.

The dual hull kayak is so stable laterally that it can be used as a diving platform and can be remounted by a swimmer from the water without tipping or overturning. Conventional kayaks or canoes require expert level skill to accomplish the same re-entry task. An overturned canoe or kayak of traditional design can represent a life threatening danger to children or novice users even if lifejackets are worn due to the risk of head impact injury and hypothermia.

The stable dual hull design of the invention substantially reduces the risk of tipping, and enables users to easily re-enter the kayak from the water. These features increase the safety of use and increase overall enjoyment of the boating experience.

If desired the kayak can be inverted and the tunnel shape of the bottom wall provides a rigid water slide for children or water rescue cradle. The kayak body includes bow eyelets and is rigid enough to be safely towed with a tow rope behind a motor boat.

Further details of the invention and its advantages will be apparent from the detailed description and drawings included below.

BRIEF DESCRIPTION OF THE DRAWINGS

In order that the invention may be readily understood, one preferred embodiment of the invention will be described by way of example, with reference to the accompanying drawings wherein.

DETAILED DESCRIPTION OF PREFERRED EMBODIMENTS

Figure 1:
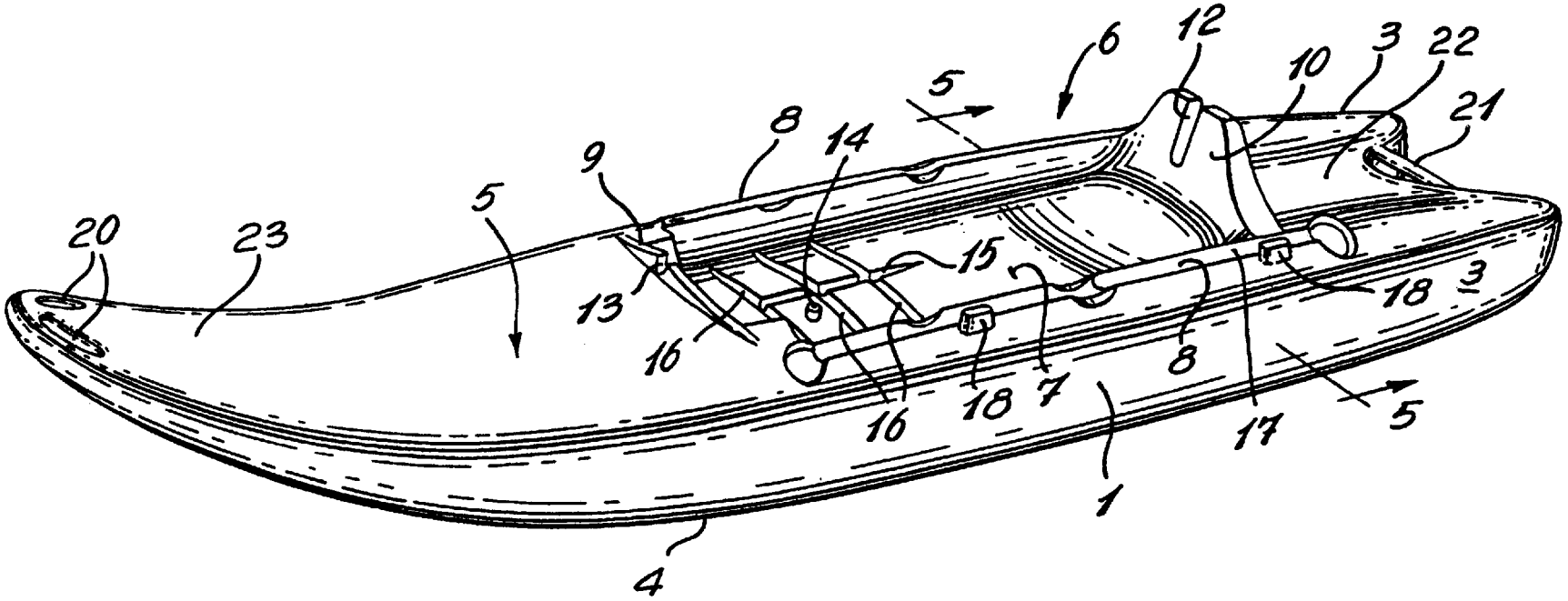
FIG. 1 is a top perspective view of the dual hull kayak showing the recessed cockpit with raised seat and back rest.

With reference to FIG. 1, the invention provides a simple design for a dual hull kayak having a one piece elongate molded body of a continuous outer plastic or fiberglass membrane enclosing an internal air-filled cavity. The internal air-filled cavity provides excellent buoyancy. The smooth molded exterior reduces water resistance. Mass production in various colours provides efficient low cost production using known molding technology.

Figure 4:
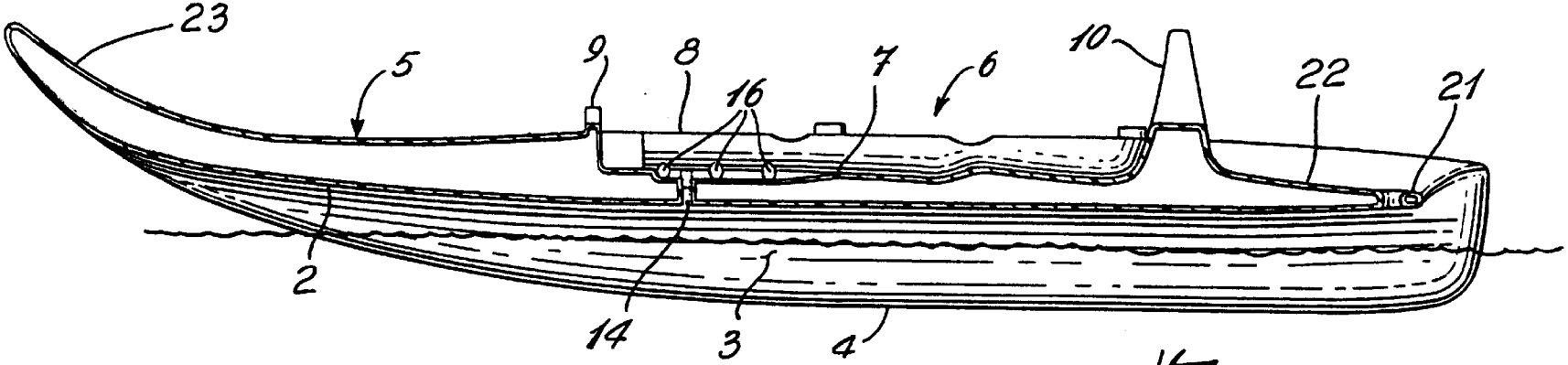
FIG. 4 is a longitudinal sectional view.
Figure 5:
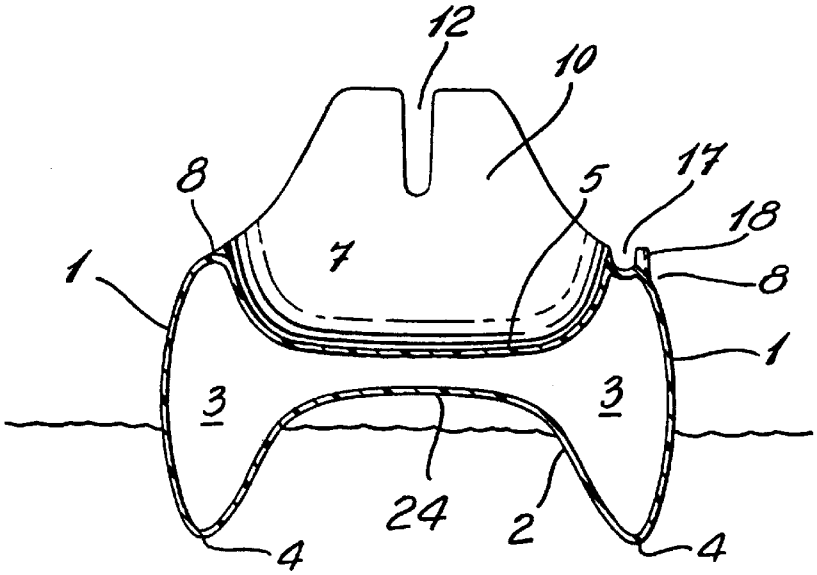
FIG. 5 is a transverse sectional view along line 5—5 of FIG. 1.

The details of construction are illustrated in sectional FIGS. 4 and 5. The dual hull kayak body has two lateral side walls 1 and a concave bottom wall 2. The bottom wall 2 is laterally joined with the bottom edge of each side wall 1 to define to laterally spaced apart parallel pontoons 3 which each enclose a volume of air for buoyancy and lateral stability. Each pontoon 3 has a downwardly pointed keel 4 and the pontoons 3 support the top of the concave bottom wall 24 above the water line.

The depth of the submerged keel 4 and the semi-cylindrical tunnel formed by the concave bottom wall 2 improve directional stability and enable even a novice paddler to propel the dual hull kayak in a straight direction. The depth of the keel 4 also provides resistance against lateral drift when encountering lateral winds. As clear from FIG. 5, the relatively large volume of air contained within each pontoon 3 provides excellent lateral stability and buoyant force. This buoyant force in the pontoons 3 resists tipping and enables a user to re-enter the dual hull kayak from the water surface without overturning the kayak.

As shown in FIGS. 4 and 5, the kayak includes a top wall 5 joined on its lateral edges with a top edge of each side wall 1. The top wall 5 includes an open cockpit 6 with a floor 7 and gunnels 8. The front cockpit wall 9 is shown in FIG. 4 as an upwardly extending reinforcing rib 9 and the back cockpit wall 10 also comprises a transverse reinforcing rib 10 upwardly extending from the top wall 5 in the shape of a seat backrest 10.

As indicated in FIG. 5, the top wall 5 including cockpit 6, combined with the concave bottom wall 5 defines a bridge platform spanning a central longitudinal tunnel between the pontoons 3. The bridge platform and transverse ribs 9, 10 provide stable support and join the pontoons 3 together into an integral body structure.

The one piece molded body of the kayak provides a continuous outer membrane comprised of the bottom wall 2, side walls 1 and top wall 5 to enclose and contain a relatively large volume of air within an airtight internal cavity. The bulk of the air is contained within the pontoons 3 in order to provide a buoyant force laterally extended outwardly from the center of gravity of the kayak and seated passenger. As a result, the invention provides a kayak with superior lateral stability in comparison with conventional kayaks and canoes. As well the one piece molded construction utilizes conventional technology for molding and manufacturing resulting in significant cost efficiencies in production.

Several further details of the design shown provide significant advantageous as follows. In order to accommodate vertical stacking of like kayaks, the illustrated embodiment shows an upper edge 11 of the seatback rest 10 with a profile that mates the bottom wall tunnel 2. During manufacture shipping or storage, the vertical stacking of the kayaks will reduce overall height allowing three or four kayaks to be nested and stacked upon each other.

Also, as indicated in the drawings, the back rib 10 or seat back 10 includes a central paddle storage slot 12. In the embodiments shown, the front rib 9 also includes a central paddle storage slot 13.

With reference to FIGS. 1 and 4 particularly, the cockpit floor 7 includes a drain hole 14 communicating with the tunnel defined by concave bottom wall 2. The cockpit floor 7 includes a recessed drainage channel 15 which is inclined towards and communicates with the drain hole 14. The cockpit floor 7 also includes recessed transversed foot rest channels 16 which in the embodiment shown also feed into the recessed drain channel 15 and provide recesses into which the user may insert heels to adopt a comfortable seated position.

As shown in FIGS. 1 and 5, at least one cockpit gunnel 8 includes a longitudinal paddle storage groove 17. A conventional kayak paddle includes a long cylindrical handle with offset paddles at both ends. The paddle storage groove 17 is concave and includes two hooks 18 to assist in retaining the paddle handle in the groove 17 while the user is seated within the cockpit 6.

Figure 2:
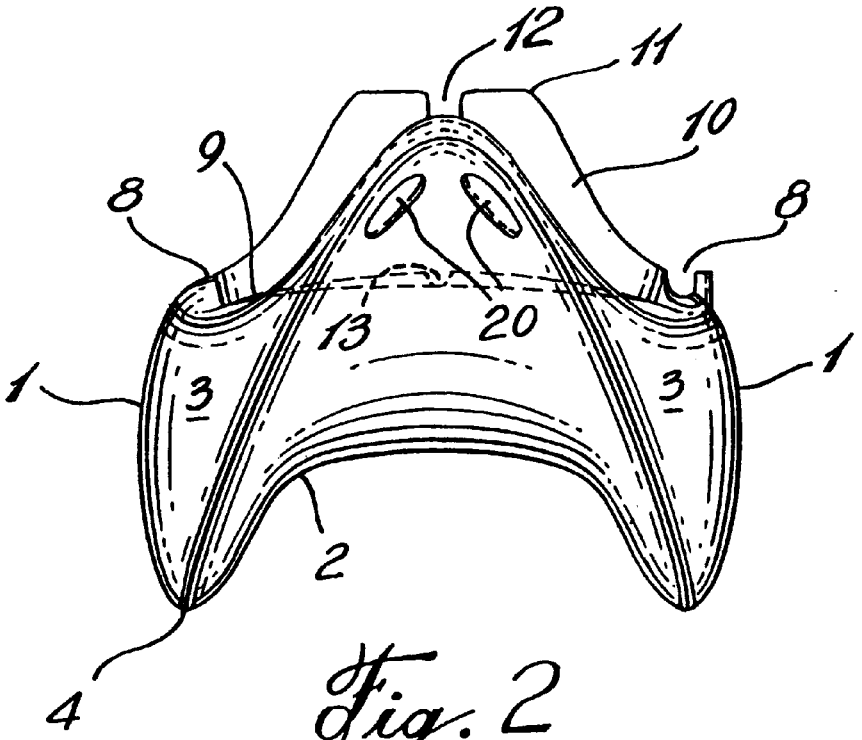
FIG. 2 is a bow elevation view.
Figure 3:
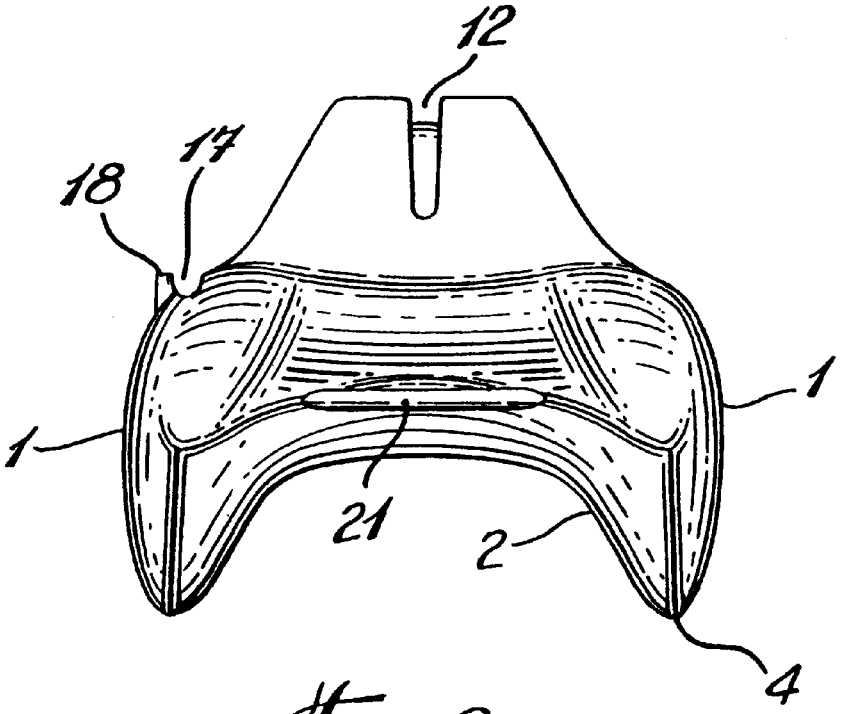
FIG. 3 is a stem elevation view.

With reference to FIGS. 1, 2 and 3, the kayak includes two bow eyelet handles 20 which provide an elongate opening large enough for an adult hand to pass through between the top and bottom walls 5 and 2. The eyelets 20 also enable a rope to be tied to the kayak securing the kayak to a motor boat or dock structure.

Also included, as shown in FIGS. 3 and 2, is a stern handle 21 which in the embodiments shown comprises a transverse rod which spans between the pontoons 3 rearward of the seatback 10. The top wall 5 and bottom wall 2 form a rear platform 22 which can be used for storage and provides a platform to assist the user in re-entering the kayak by grasping the stem handle 21. The platform 22 also increases structural strength of the kayak. The bow 23 is moderately upswept to reduce the possibility of submarining the bow 23 when riding or surfing waves.

Although the above description and accompanying drawings relate to a specific preferred embodiment as presently contemplated by the inventor, it will be understood that the invention in its broad aspect includes mechanical and functional equivalents of the elements described and illustrated.

The embodiments of the invention in which an exclusive property or privilege is claimed are defined as follows:

1. A dual hull kayak for floating on a water surface, comprising:

a one piece elongate moulded body formed of a continuous outer membrane, said body having two lateral side walls;

a concave bottom wall joined laterally with a bottom edge of each side wall thus defining two laterally spaced apart parallel pontoons each with a downwardly pointed keel;

a top wall joined laterally with a top edge of each side wall, the top wall together with the bottom wall defining a bridge platform spanning a central longitudinal tunnel between the pontoons; and a recessed open cockpit in the top wall with a floor, gunnels, front and back cockpit walls, said body defining an enclosed internal air cavity dimensioned wherein the pontoons have sufficient buoyancy to support a top portion of the tunnel above the water surface.

2. A dual hull kayak according to claim 1 wherein the front and back cockpit walls comprise transverse reinforcing ribs upwardly extending from the top wall.

3. A dual hull kayak according to claim 2 wherein the back rib comprises a seat back rest.

4. A dual hull kayak according to claim 3 wherein an upper edge of the seat back rest has a profile mating the bottom wall tunnel to accommodate vertical stacking of like kayaks.

5. A dual hull kayak according to claim 2 wherein at least one rib includes a central paddle storage slot.

6. A dual hull kayak according to claim 1 wherein the cockpit floor includes a drain hole communicating with the tunnel.

7. A dual hull kayak according to claim 6 wherein the cockpit floor includes a recessed drainage channel inclined toward and communicating with the drain hole.

8. A dual hull kayak according to claim 1 wherein the cockpit floor includes recessed transverse foot rest channels.

9. A dual hull kayak according to claim 1 wherein the bow is upswept.

10. A dual hull kayak according to claim 1 wherein at each cockpit gunnel includes a transverse paddle storage scallop.

11. A dual hull kayak according to claim 1 including a bow eyelet handle comprising an elongate opening between the top and bottom walls.

12. A dual hull kayak according to claim 1 including a stern handle comprising a transverse rod spanning between the pontoons.

13. A dual hull kayak for floating on a water surface, said kayak comprised of:

an elongated, molded body formed of a continuous outer membrane, said body having two, spaced-apart lateral side wall portions, each having a top edge and a bottom edge, a concave bottom wall portion joining said bottom edges of said side wall portions, and a top wall portion joining said top edges of said side wall portions, said side wall portions, said bottom wall portion and said top wall portion defining two laterally, spaced-apart, parallel pontoons and a bridge platform spanning said pontoons, said pontoons and said bridge platform defining a central, longitudinal tunnel between said pontoons, said molded body defining an internal air cavity having sufficient volume wherein said kayak is supported by said pontoons on said water surface with said bridge platform above said water surface.

14. A dual hull kayak according to claim 13 further comprising a recessed open cockpit in said top wall portion, said cockpit having a floor, gunnels, front and back cockpit walls.

* * * * *